US010850822B1

(12) United States Patent
Sawyer et al.

(10) Patent No.: US 10,850,822 B1
(45) Date of Patent: Dec. 1, 2020

(54) SPLINED AND THREADED SHAFT FOR MARINE DRIVE

(71) Applicant: Brunswick Corporation, Mettawa, IL (US)

(72) Inventors: Kass W. Sawyer, Neenah, WI (US); Laura K. Mueller, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 3 days.

(21) Appl. No.: 16/454,400

(22) Filed: Jun. 27, 2019

(51) Int. Cl.
*B63H 20/14* (2006.01)

(52) U.S. Cl.
CPC ..... *B63H 20/14* (2013.01)

(58) Field of Classification Search
CPC ..... B63H 20/14; B63H 23/34; B63H 23/342
See application file for complete search history.

(56) References Cited

U.S. PATENT DOCUMENTS

| | | | | |
|---|---|---|---|---|
| 2,297,390 A | | 9/1942 | Burger | |
| 2,313,105 A | * | 3/1943 | Walls | B25B 13/48 29/271 |
| 2,691,876 A | * | 10/1954 | Wildhaber | B60K 17/16 464/123 |
| 3,104,493 A | | 9/1963 | Nalle | |
| 3,727,574 A | * | 4/1973 | Bagge | B63H 20/002 440/66 |
| 4,292,001 A | | 9/1981 | Snell | |
| 4,657,428 A | | 4/1987 | Wiley | |
| 4,682,532 A | | 7/1987 | Erlandson | |
| 5,230,644 A | | 7/1993 | Meisenburg et al. | |
| 5,249,995 A | | 10/1993 | Meisenburg et al. | |
| 5,462,463 A | * | 10/1995 | Meisenburg | B63H 5/10 440/80 |
| 5,791,951 A | | 8/1998 | Staerzl | |
| 5,902,160 A | | 5/1999 | Weronke et al. | |
| 6,062,926 A | | 5/2000 | Alexander, Jr. et al. | |
| 6,478,543 B1 | | 11/2002 | Tuchscherer et al. | |

(Continued)

FOREIGN PATENT DOCUMENTS

| | | |
|---|---|---|
| CN | 205155061 U | 4/2016 |
| CN | 107186155 A | 9/2017 |
| GB | 616696 A | 1/1949 |

OTHER PUBLICATIONS

CR Tools Sheffield, "Cutting Tools Sheffield," website, admitted prior art, available at https://crtoolsuk.com/cutting-tools-sheffield/, last accessed May 3, 2019.

(Continued)

*Primary Examiner* — Stephen P Avila
(74) *Attorney, Agent, or Firm* — Andrus Intellectual Property Law, LLP

(57) ABSTRACT

A propeller shaft includes a cylindrical outer surface having a series of external splines formed thereupon and having a series of external threads formed in the series of external splines. The series of external splines engages with a mating series of internal splines on a driven gear. The series of external threads engages with a mating series of internal threads on a nut that holds the driven gear axially in place on the propeller shaft. A shaft for a marine drive unit and a marine drive assembly are also described.

20 Claims, 5 Drawing Sheets

(56) References Cited

U.S. PATENT DOCUMENTS

| | | | | |
|---|---|---|---|---|
| 7,223,076 | B2 | 5/2007 | Mansson | |
| 9,630,692 | B2 | 4/2017 | Hasl et al. | |
| 9,944,377 | B2 * | 4/2018 | Davidson | H02K 7/06 |
| 10,323,721 | B1 | 6/2019 | Smith et al. | |
| 2006/0165531 | A1 * | 7/2006 | Mansson | B63H 23/34 416/244 B |
| 2010/0116470 | A1 | 5/2010 | Hsu et al. | |
| 2020/0132182 | A1 * | 4/2020 | Davenport | B63H 23/06 |

OTHER PUBLICATIONS

Wikipedia, "Hobbing," website, admitted prior art, available at https://en.wikipedia.org/wiki/Hobbing, last accessed May 3, 2019.
Endless Sphere, "Shaft adapter, splined and threaded for freewheel and cog," Jun. 16, 2017, available at https://endless-sphere.com/forums/viewtopic.php?t=89285, last accessed May 3, 2019.
Volvo, "Forward Drive," 2015, see attached Declaration.
Sawyer et al., "Marine Drives and Assemblies for Supporting an Output Gear in a Marine Drive," Unpublished U.S. Appl. No. 14/268,622, filed May 2, 2014.

* cited by examiner

SPLINED AND THREADED SHAFT FOR MARINE DRIVE

FIELD

The present disclosure relates to marine drive units and more specifically to shafts, such as, but not limited to, propeller shafts for marine drive units.

BACKGROUND

U.S. Pat. No. 5,230,644 discloses a marine drive having two counter-rotating surface operating propellers. An upper adaptor spool has a lower threaded outer portion mating with a threaded portion of the vertical bore of the drive housing and supporting the upper gear for rotation about the driveshaft and supporting the driveshaft for rotation within the adaptor spool. Vertical bore structure enables assembly from above of the majority of the vertical drive train components into a one-piece unitary integrally cast housing. The vertical distance between the adaptor spool and the lower bearing supporting the vertical driveshaft is about equal to propeller radius. The lower concentric counter-rotating propeller shafts are spaced from the upper input shaft by a distance along the driveshaft in the range of about 9 to 15 inches.

U.S. Pat. No. 5,249,995 discloses a marine drive having two counter-rotating surface operating propellers. Inner and outer concentric counter-rotating propeller shafts are supported by a spool assembly locked and retained against rotation and against axial movement in the lower horizontal bore in the torpedo of the drive housing by axially spaced left and right hand threads. A thrust bearing assembly transfers thrust from the outer propeller shaft to the inner propeller shaft during rotation of the propeller shafts in opposite axial direction and is axially located between fore and aft driven gears. Propeller shaft sealing and bearing structure, and propeller self-centering mounting structure is provided.

The above-noted patents are hereby incorporated herein by reference in their entireties.

SUMMARY

This Summary is provided to introduce a selection of concepts that are further described in the following Detailed Description. This Summary is not intended to identify key or essential features of the claimed subject matter, nor is it intended to be used as an aid in limiting the scope of the claimed subject matter.

According to one example of the present disclosure, a propeller shaft comprises a cylindrical outer surface having a series of external splines formed thereupon and having a series of external threads formed in the series of external splines. The series of external splines is configured to engage with a mating series of internal splines on a driven gear. The series of external threads is configured to engage with a nut that holds the driven gear axially in place on the propeller shaft.

According to another example of the present disclosure, a shaft for a marine drive unit comprises a cylindrical outer surface having a series of external splines formed thereupon and having a series of external threads formed in the series of external splines. The series of external splines is configured to engage with a mating series of internal splines on a gear. The series of external threads is configured to engage with a nut that holds the gear axially in place on the shaft.

According to yet another example of the present disclosure, a marine drive assembly comprises a drive shaft having a pinion gear coupled to a lower end thereof. First and second concentric counter-rotating propeller shafts are provided, each propeller shaft having a respective first or second series of external splines formed on at least a portion of an outer surface thereof. A first driven gear is meshed with the pinion gear and connected to the first propeller shaft by a first series of internal splines. A second driven gear is meshed with the pinion gear and connected to the second propeller shaft by a second series of internal splines. A nut surrounds at least one of the first and second propeller shafts and fixes a respective one of the first and second driven gears axially with respect to the at least one of the first and second propeller shafts. The at least one of the first and second propeller shafts comprises a series of threads formed in the respective first or second series of external splines for mating with the nut.

BRIEF DESCRIPTION OF THE DRAWINGS

Examples of a marine drive assembly and shafts used therein are described with reference to the following figures. The same numbers are used throughout the figures to reference like features and like components.

DETAILED DESCRIPTION OF THE DRAWINGS

In the present description, certain terms have been used for brevity, clarity, and understanding. No unnecessary limitations are to be implied therefrom beyond the requirement of the prior art because such terms are used for descriptive purposes only and are intended to be broadly construed. The assemblies and methods described herein may be used alone or in combination with other assemblies and methods. Various equivalents, alternatives and modifications are possible within the scope of the appended claims.

Figure 1:
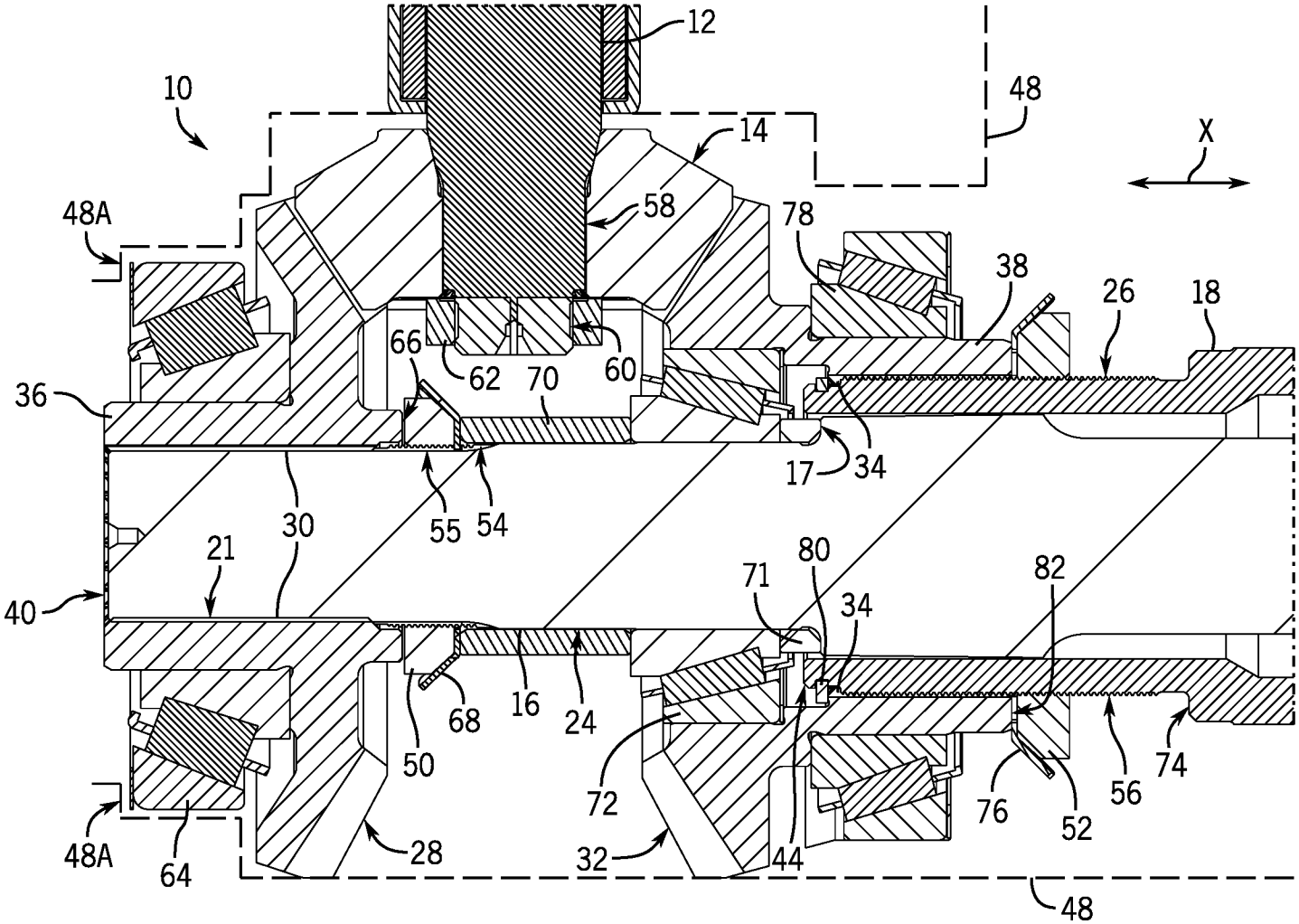
FIG. 1 illustrates parts of a marine drive assembly according to the present disclosure.
Figure 2:
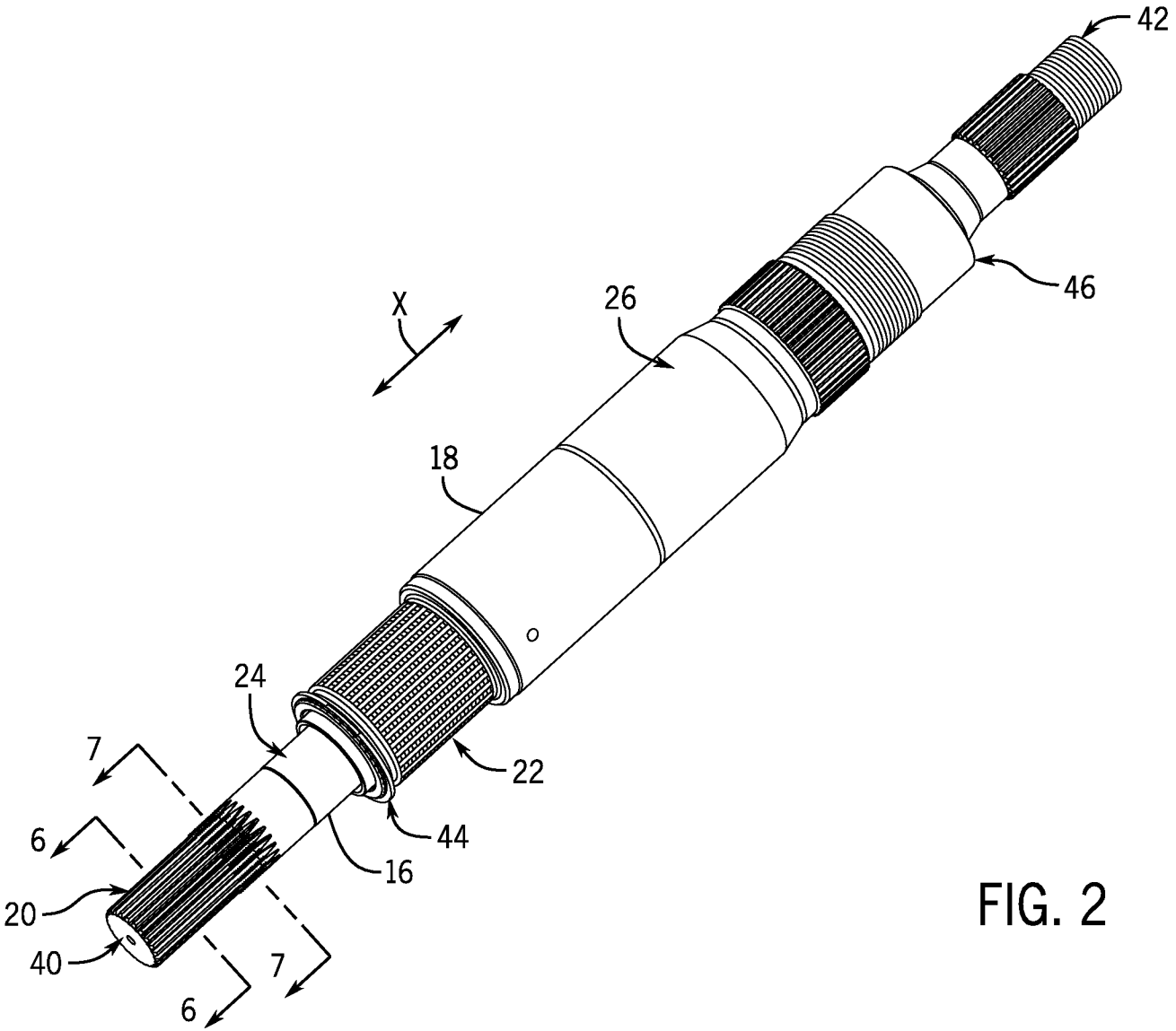
FIG. 2 illustrates dual counter-rotating propeller shafts according to the present disclosure.

FIG. 1 illustrates part of a marine drive assembly 10. The marine drive assembly 10 comprises a drive shaft 12 having a pinion gear 14 coupled to a lower end thereof. First and second concentric counter-rotating propeller shafts 16, 18 are provided, each propeller shaft 16, 18 having a respective first or second series of external splines 20, 22 (FIG. 2) formed on at least a portion of an outer surface 24, 26 thereof. For example, the splines can be cut from the shaft or rolled onto the shaft, as known to one having ordinary skill in the art. A first driven gear 28 is meshed with the pinion gear 14 and connected to the first propeller shaft 16 by a first series of internal splines 30. A second driven gear 32 is meshed with the pinion gear 14 and connected to the second propeller shaft 18 by a second series of internal splines 34. Although only two of the splines in each of the first and second series of internal splines 30, 34 on the first and second driven gears 28, 32, respectively, is shown in FIG. 1, those having ordinary skill in the art would recognize that such series of internal splines 30, 34 are provided around an entire internal surface of the hollow hubs 36, 38 of the first and second driven gears 28, 32. Correspondingly, as shown in FIG. 2, the first and second series of external splines 20, 22 are formed around entire circumferences of the outer surfaces 24, 26 of the first and second propeller shafts 16, 18. The mating first series of external splines 20 on the first propeller shaft 16 and first series of internal splines 30 on the first driven gear 28 allow torque to be transferred from the drive shaft 12, to the pinion gear 14, to the first driven gear 28, to the first propeller shaft 16. The mating second series of external splines 22 on the second propeller shaft 18 and second series of internal splines 34 on the second driven gear 32 allow torque to be transferred from the drive shaft 12, to the pinion gear 14, to the second driven gear 32, to the second propeller shaft 18.

Referring to both FIGS. 1 and 2, the first propeller shaft 16 extends from an end 40 proximal to the drive shaft 12 to an end 42 distal to the drive shaft 12. The proximal end 40 receives torque from the drive shaft 12 via the pinion gear 14 and first driven gear 28, as described herein above, to rotate a first propeller (not shown) at the distal end 42 in a first direction. The second propeller shaft 18 also extends from an end 44 proximal to the drive shaft 12 to an end 46 distal to the drive shaft 12. The proximal end 44 receives torque from the drive shaft 12 via the pinion gear 14 and second driven gear 32, as described herein above, to rotate a second propeller (not shown) at the distal end 46 in a second direction that is opposite the first direction. Those having ordinary skill in the art will recognize that the marine drive assembly 10 is configured to be held in a gear case 48 (the inner bore of which is shown schematically in FIG. 1) of a marine drive unit, such as an outboard motor, stern drive, or other known drive unit for generating thrust to propel a boat.

As consumers have tended to demand more power for their boats, they have installed multiple marine drive units on a single boat's transom. When multiple drive units are installed on a single transom, it is desirable to ensure that, as the drive units are steered, tilted, and/or trimmed, they do not interfere with one another, which would cause damage to the drive unit. Therefore, the present inventors were tasked with making a drive unit as compact as possible, thereby allowing more drive units to be installed on a boat's transom with less risk of interference therebetween. Through research and development, the present inventors realized that being able to clamp or preload a component with an internal spline that transmits torque (such as the above-noted first and second driven gears 28, 32) without being able to access the end of the shaft to which the component is splined (such as first and second propeller shafts 16, 18) would allow the gear case 48 to be made more compact in an axial direction X.

Figure 3:
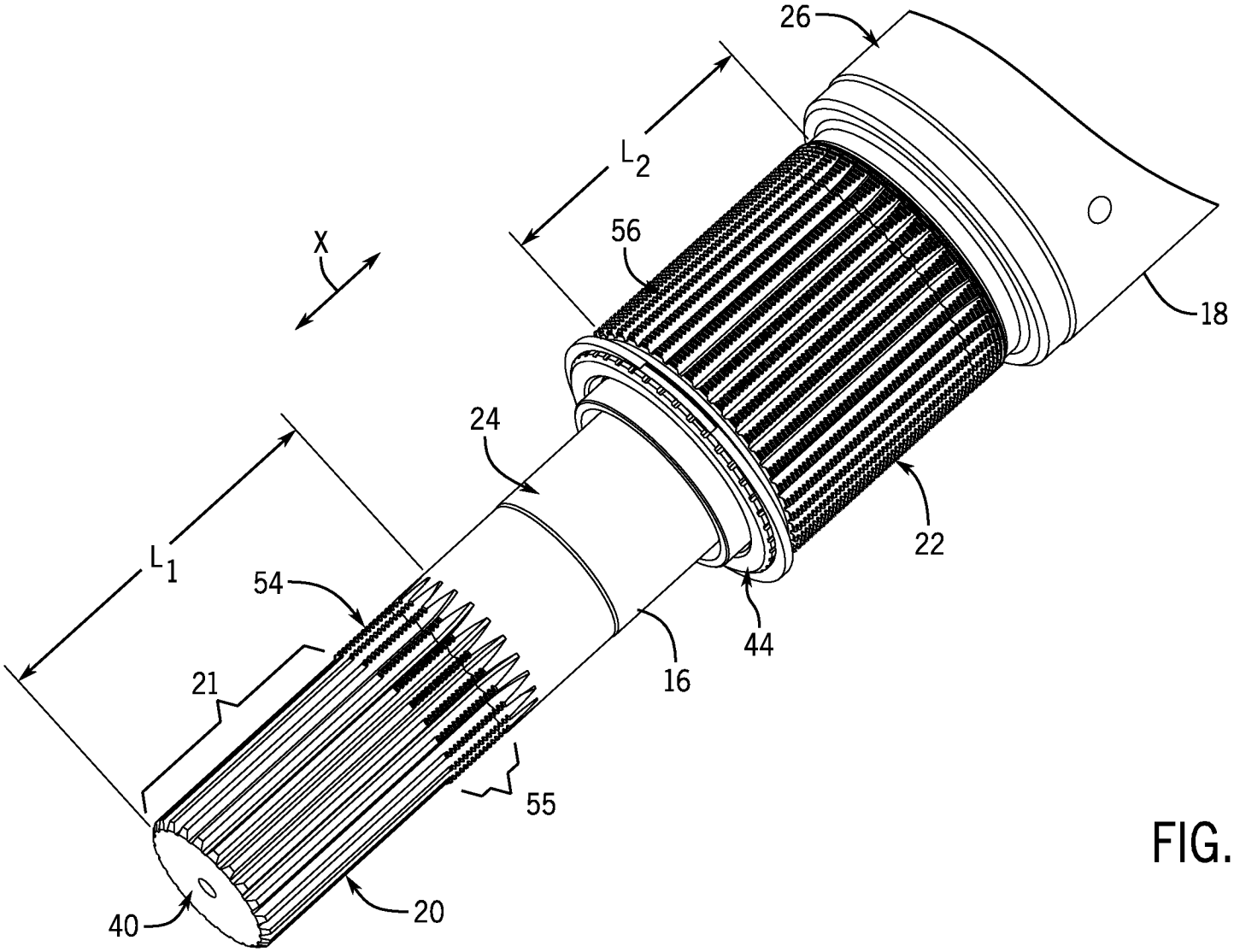
FIG. 3 illustrates proximal ends of the dual counter-rotating propeller shafts of FIG. 2.

In order to accomplish such clamping/preloading of the driven gear 28 and/or 32 in the axial direction X, nut(s) 50 and/or 52 surround(s) at least one of the first and second propeller shafts 16, 18 and fix(es) a respective one of the first and second driven gears 28, 32 axially with respect to the at least one of the first and second propeller shafts 16, 18. The at least one of the first and second propeller shafts 16, 18 comprises a series of threads 54, 56 formed in the respective first or second series of external splines 20, 22 for mating with the nut 50, 52. Here, as shown in FIGS. 1 and 3, both of the first and second propeller shafts 16, 18 comprise a series of threads 54, 56 formed in the respective first and second series of external splines 20, 22. However, only one of the first and second propeller shafts 16, 18 may have threaded splines according to design choice and/or space constraints. Additionally, with respect to the second propeller shaft 18, note that the series of external threads 56 extends along an entire axial length $L_2$ of the series of external splines 22; however, with respect to the first propeller shaft 16, the series of external threads 54 extends along less than the entire axial length L1 of the series of external splines 20, such that the propeller shaft 16 comprises a threaded splined portion 55 and an unthreaded splined portion 21. Both of the series of external threads 54, 56 are continuously threaded, so as to enable the nuts 50, 52 to provide adequate clamping/preload force on the respective driven gears 28, 32.

Figure 4:
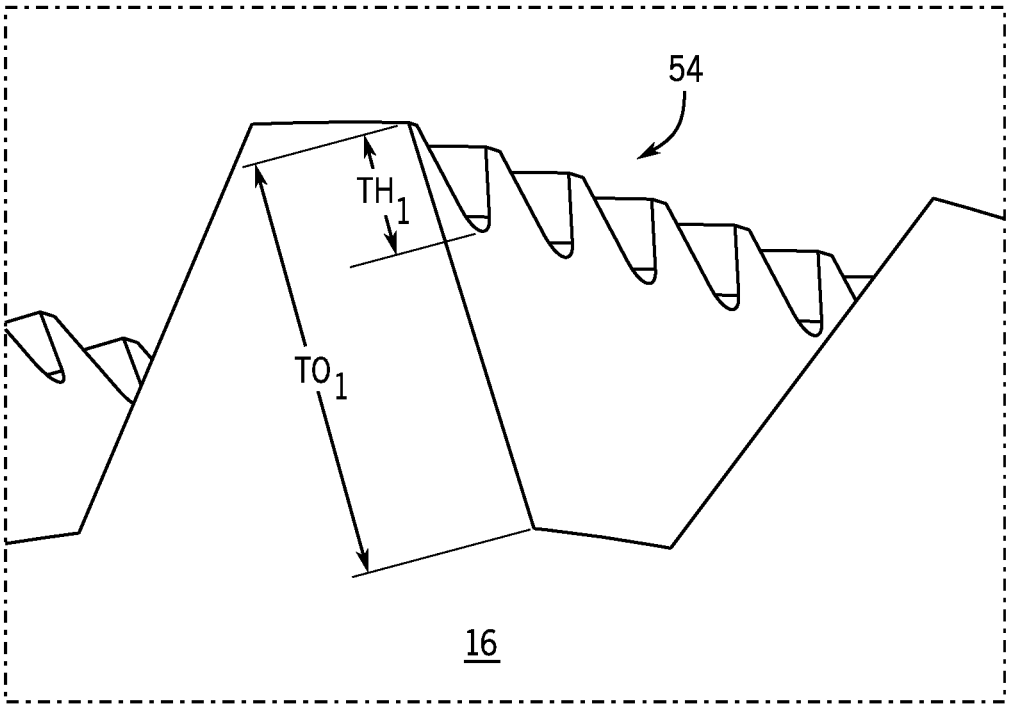
FIG. 4 illustrates a close-up cross-sectional view of one of the propeller shafts of FIG. 3.
Figure 5:
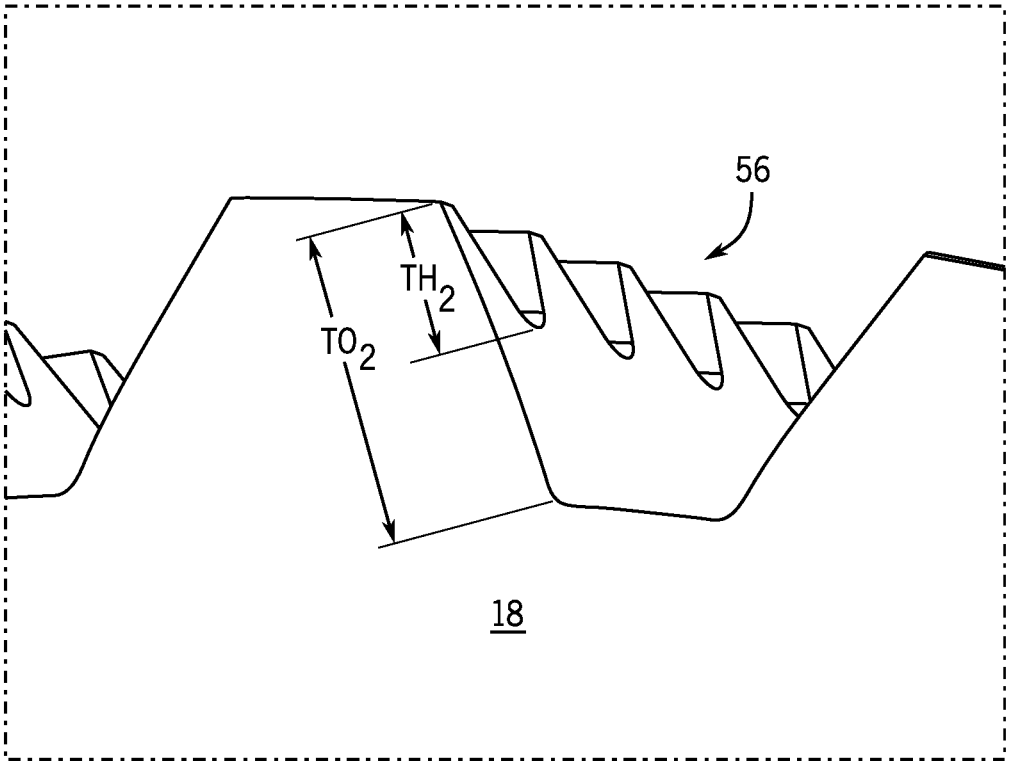
FIG. 5 illustrates a close-up cross-sectional view of the other of the propeller shafts of FIG. 3.

FIG. 4 shows a detailed cross section through the first propeller shaft 16 in the area where is it both threaded and splined. As shown, the first series of external threads 54 has a thread depth $TH_1$ that is less than half of a tooth depth $TO_1$ of the first series of external splines 20. FIG. 5 shows a cross-section through the second propeller shaft 18 in the area where it is both threaded and splined. Similarly, the thread depth $TH_2$ of the second series of external threads 56 is less than half of the tooth depth $TO_2$ of the second series of external splines 22. This allows the shafts 16, 18 to be manufactured without burs from either manufacturing of the splines or cutting of the threads causing a deburring issue. Additionally, the series of external splines 20, 22 are still deep enough to safely and effectively transmit torque from the series of internal splines 30, 34, respectively, of the first and second driven gears 28, 32.

Returning to FIGS. 1 and 2, each of the nuts 50, 52 is located at an end of the respective one of the first and second driven gears 28, 32 that faces the respective distal end 42, 46 of the first or second propeller shaft 16, 18. According to the configuration of the marine drive assembly 10 shown herein, the nuts 50, 52 are therefore not "available" to the manufacturer when the marine drive assembly 10 is complete. Put another way, the nuts 50, 52 are not removable from the first and second propeller shafts 16, 18 without a respective one of the first and second driven gears 28, 32 being removed from the first and second propeller shafts 16, 18. This is in contrast to prior art assemblies, in which the first driven gear 28 might be clamped by an end plate bolted to the proximal end 40 of the first propeller shaft 16. This is also in contrast to prior art systems in which the end of a splined shaft, such as drive shaft 12 (which is splined at area 58 for connection with internal splines on pinion gear 14), is reduced in diameter and threaded at the reduced-diameter section 60. A nut 62 is then threaded onto the reduced-diameter section 60 and clamps/preloads the pinion gear 14 on the drive shaft 12 within the hollow of the gear case 48.

It can be seen from examination of FIG. 1 that if the drive shaft 12 and pinion gear 14 are assembled to one another before the first propeller shaft 16 is provided in the gear case 48, the reduced-diameter section 60 of drive shaft 12 is available to the manufacturer for threading on and tightening the nut 62. Due to the dimensions of the pinion gear 14 and first and second driven gears 28, 32, having the extra length of the reduced-diameter section 60 at the end of drive shaft 12 is not detrimental to the overall dimensions (packaging) of the marine drive assembly 10. However, adding a reduced-diameter section or end plate to clamp the first and/or second driven gears 28, 32 in the axial direction X would require the overall axial dimension of the marine drive assembly 10 to change. Thus, the present inventors threaded the splined sections of the first and second propeller shafts 16, 18 to allow the nuts 50, 52 to be provided along already existing lengths of the propeller shafts 16, 18.

To assemble the marine drive assembly 10 of the present disclosure, the first driven gear 28, with bearing 64 provided on its hub 36, is slid into the gear case 48 until reaching a forward shoulder 48*a* defined therein. The pinion gear 14 is next inserted and connected to the drive shaft 12 by way of splines at area 58 and nut 62 around reduced-diameter section 60. The nut 50, a washer 68, a spacer sleeve 70, a bearing 72, another spacer 71, and any other components surrounding the first propeller shaft 16 between its proximal end 40 and the proximal end 44 of the second propeller shaft 18 are preassembled on the first propeller shaft 16. This is done by sliding the above-noted components (in reverse order) onto the first propeller shaft 16 via the proximal end 40, over the unthreaded splined portion 21, and then over the threaded splined portion 55, until reaching a shoulder 17 formed on the first propeller shaft 16. The nut 50 is then slid over the unthreaded splined portion 21 via the proximal end 40 and tightened about the threaded splined portion 55 until it secures the other components in place against the shoulder 17. The first propeller shaft 16 is then inserted into the gear case 48 from the rear end thereof. The series of external splines 20 immediately at the proximal end 40 of the first propeller shaft 16 does not need to be threaded (see FIG. 3), as this area is simply splined to the first series of internal splines 30 of the first driven gear 28. After the first propeller shaft 16 is inserted into the first driven gear 28, the nut 50 is tightened toward the end 66 of the gear's hub 36 that faces the distal end 42 of the first propeller shaft 16. In the present example, the washer 68 is a tab washer, the tab of which is then bent over into a notch in the nut 50 to secure the connection.

The second propeller shaft 18 is also pre-assembled with components before insertion into the gear case 48. The nut 52 is turned on the outer surface 26 of the second propeller shaft 18 until it hits a shoulder 74 thereupon. A washer 76 is then slid on, after which the second driven gear 32, around which bearing 78 (or at least part thereof) is already provided, is slid onto the second propeller shaft 18. A snap ring 80 is then assembled into a groove on proximal end 44 of second propeller shaft 18, after which the second driven gear 32 is slid back toward the snap ring 80 until an inner shoulder on the gear's hub 38 contacts the snap ring 80. The nut 52 is then tightened against the end 82 of the hub 38 of second driven gear 32 that faces the distal end 46 of the second propeller shaft 18, and tabs of washer 76 are bent over into notches in the nut 52 to secure the connection. The second propeller shaft 18 is then assembled into the gear case 48, after which a bearing carrier (not shown) with an outer race of bearing 78 may then be provided.

Although tab washers 68, 76 are shown and described herein for preventing the nuts 50, 52, respectively, from coming loose, in other examples, elastic filament, set screws, liquid locking compound, or other known devices for similar purposes could be provided.

Figure 6:
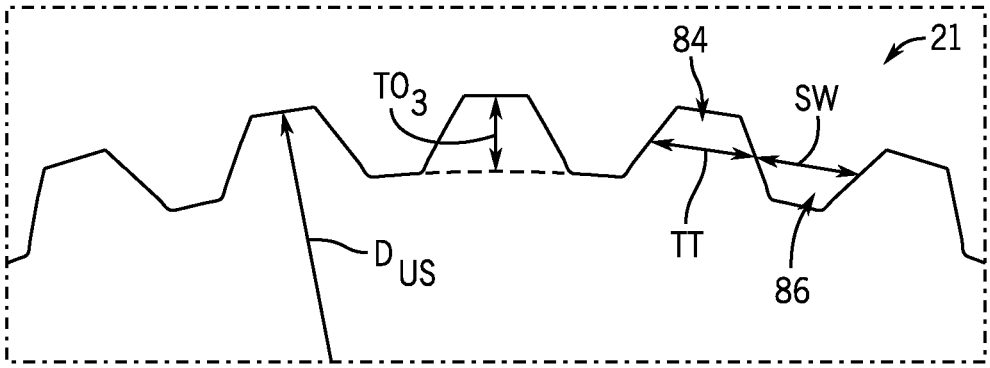
FIG. 6 shows a cross-section of the propeller shaft taken along the line 6-6 in FIG. 2.
Figure 7:
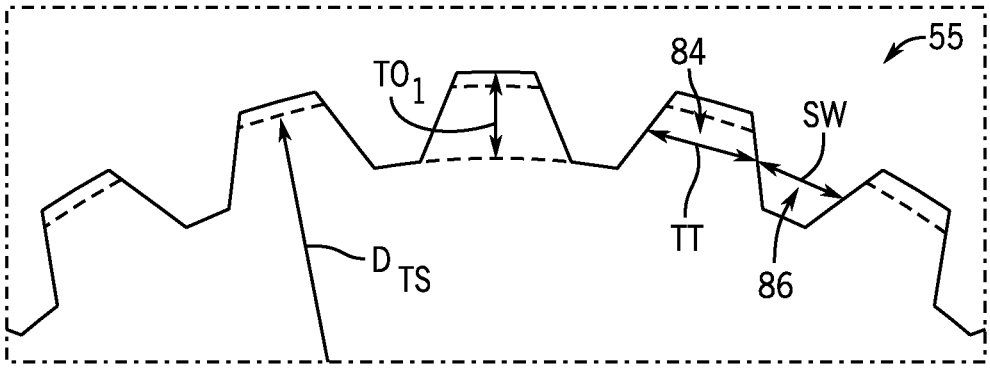
FIG. 7 shows a cross-section of the propeller shaft taken along the line 7-7 in FIG. 2.

Comparison of FIGS. 6 and 7 shows another aspect of the first propeller shaft 16. FIG. 6 shows a cross-section through the unthreaded splined portion 21 of the propeller shaft 16. The major diameter of the unthreaded splines in the first series of external splines 20 is labeled $D_{US}$. In comparison, FIG. 7 shows a cross-section through the threaded splined portion 55 of the first propeller shaft 16, taken at a section across the full height of the threading. The major diameter of the threaded splines in the first series of external splines 20 is labeled $D_{TS}$. According to the design of the present propeller shaft 16, the major diameter $D_{TS}$ of the external splines in the threaded splined portion 55 is not less than the major diameter $D_{US}$ of the external splines in the unthreaded splined portion 21. In other words, $D_{TS} \geq D_{US}$. This is because, as noted hereinabove, the nut 50 is slid onto the first propeller shaft 16 from the proximal end 40 thereof, over unthreaded splined portion 21, and then threaded around threaded splined portion 55. If the splines in the threaded splined portion 55 had a smaller major diameter than the splines in the unthreaded splined portion 21, then the nut 50 would need to have a smaller inner diameter in order to engage with the series of threads 54 and clamp the first driven gear 28 in place. However, in that instance, a nut 50 with a smaller inner diameter would not be able to fit over the unthreaded splined portion 21 of the shaft 16, which is closer to the proximal end 40 than is the threaded splined portion 55. By instead manufacturing the threaded splined portion 55 with splines having a major diameter $D_{TS}$ that is greater than or equal to the major diameter $D_{US}$ of the unthreaded splined portion 21, the nut 50 is able to be designed with an inner diameter than can easily slide over the unthreaded splined portion 21 and then engage with the series of threads 54 on threaded splined portion 55. For the same reason, the total tooth depth $TO_1$ in the threaded splined portion 55 is greater than the total tooth depth $TO_3$ in the unthreaded splined portion 21.

Review of FIGS. 6 and 7 also shows how the splines 84 and spaces 86 of the series of external splines 20 have roughly equal dimensions. In other words, the tooth thickness TT (actual or effective) of each spline 84 is about the same (e.g., +/−10%) as the space width SW of each space 86. This ensures that there is good torque transfer around the circumference of the first propeller shaft 16, as well as provides strength, as the corresponding splines and spaces on the inner diameter of the first driven gear 28 are manufactured with corresponding dimensions. Note that although the splines 22 of the second propeller shaft 18 are not shown here in cross-section, they too have tooth thicknesses that are about the same (e.g., +/−10%) as the widths of the spaces. See FIG. 5.

Thus, the present disclosure is of a propeller shaft 16, 18 comprising a cylindrical outer surface 24, 26 having a series of external splines 20, 22 formed thereupon and having a series of external threads 54, 56 formed in the series of external splines 20, 22. The series of external splines 20, 22 is configured to engage with a mating series of internal splines 30, 34 on a driven gear 28, 32, and the series of external threads 54, 56 is configured to engage with a nut 50, 52 that holds the driven gear 28, 32 axially in place on the propeller shaft 16, 18. According to the present example, the propeller shaft 16, 18 is configured as part of a dual-shaft counter-rotating propeller shaft assembly, and the propeller shaft is configured to be used in a marine drive unit; however, the propeller shaft could be used in other mechanical devices equipped with propellers, including single-propeller marine drives.

Another example of the present disclosure is of shaft 16, 18 for a marine drive unit, the shaft 16, 18 comprising a cylindrical outer surface 24, 26 having a series of external splines 20, 22 formed thereupon and having a series of external threads 54, 56 formed in the series of external splines 20, 22. The series of external splines 20, 22 is configured to engage with a mating series of internal splines 30, 34 on a gear 28, 32, and the series of external threads 54, 56 is configured to engage with a nut 50, 52 that holds the gear 28, 32 axially in place on the shaft 16, 18. In the example described herein above, the shaft is a propeller shaft configured to be coupled to the gear 28, 32 at a proximal end 40, 44 thereof and configured to be coupled to a hub of a propeller (not shown) at a distal end 42, 46 thereof. The propeller shaft(s) can be configured as part of a dual-shaft counter-rotating propeller shaft assembly or, as noted above, a single-propeller marine drive.

In still other examples, the shafts described herein above could be part of any dual-shaft counter-rotating assembly or of any splined assembly where axial preloading by a nut is required. For example, the drive shaft 12 could have threaded splines, and a similar concept could be employed as that described herein above.

The present inventors have found that manufacturing the propeller shafts 16, 18 can be accomplished by threading the noted areas of the shafts prior to hobbing the splines; however, other manufacturing techniques could be used.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies and methods described herein may be used alone or in combination with other assemblies and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A propeller shaft comprising a cylindrical outer surface having a series of external splines formed thereupon and having a series of external threads formed in the series of external splines, wherein the series of external splines is configured to engage with a mating series of internal splines on a driven gear, and the series of external threads is configured to engage with a nut that holds the driven gear axially in place on the propeller shaft.

2. The propeller shaft of claim 1, wherein the series of external splines is formed around an entire circumference of the outer surface of the propeller shaft.

3. The propeller shaft of claim 1, wherein the series of external threads has a thread depth that is less than half of a tooth depth of the series of external splines.

4. The propeller shaft of claim 1, wherein the propeller shaft is configured as part of a dual-shaft counter-rotating propeller shaft assembly.

5. The propeller shaft of claim 1, wherein the propeller shaft is configured to be used in a marine drive unit.

6. The propeller shaft of claim 1, wherein the series of external threads extends along less than an entire axial length of the series of external splines, such that the propeller shaft comprises a threaded splined portion and an unthreaded splined portion.

7. The propeller shaft of claim 6, wherein a major diameter of the external splines in the threaded splined portion is not less than a major diameter of the external splines in the unthreaded splined portion.

8. A shaft for a marine drive unit, the shaft comprising a cylindrical outer surface having a series of external splines formed thereupon and having a series of external threads formed in the series of external splines, wherein the series of external splines is configured to engage with a mating series of internal splines on a gear, and the series of external threads is configured to engage with a nut that holds the gear axially in place on the shaft, and wherein the shaft is a propeller shaft configured to be coupled to the gear at a proximal end thereof and configured to be coupled to a hub of a propeller at a distal end thereof.

9. The shaft of claim 8, wherein the propeller shaft is configured as part of a dual-shaft counter-rotating propeller shaft assembly.

10. The shaft of claim 8, wherein the series of external threads extends along less than an entire axial length of the series of external splines, such that the shaft comprises a threaded splined portion and an unthreaded splined portion; and wherein a major diameter of the external splines in the threaded splined portion is not less than a major diameter of the external splines in the unthreaded splined portion.

11. A marine drive assembly comprising:

a drive shaft having a pinion gear coupled to a lower end thereof;

first and second concentric counter-rotating propeller shafts, each propeller shaft having a respective first or second series of external splines formed on at least a portion of an outer surface thereof;

a first driven gear meshed with the pinion gear and connected to the first propeller shaft by a first series of internal splines;

a second driven gear meshed with the pinion gear and connected to the second propeller shaft by a second series of internal splines; and a nut surrounding at least one of the first and second propeller shafts and fixing a respective one of the first and second driven gears axially with respect to the at least one of the first and second propeller shafts;

wherein the at least one of the first and second propeller shafts comprises a series of threads formed in the respective first or second series of external splines for mating with the nut.

12. The marine drive assembly of claim 11, wherein the at least one of the first and second propeller shafts extends from an end proximal to the drive shaft to an end distal to the drive shaft; and wherein the nut is located at an end of the respective one of the first and second driven gears that faces the distal end of the at least one of the first and second propeller shafts.

13. The marine drive assembly of claim 11, wherein the first and second series of external splines are formed around entire circumferences of the outer surfaces of the first and second propeller shafts, respectively.

14. The marine drive assembly of claim 11, wherein the series of threads is continuously threaded.

15. The marine drive assembly of claim 11, wherein the series of threads has a thread depth that is less than half of a tooth depth of the respective first or second series of external splines.

16. The marine drive assembly of claim 11, wherein the series of threads extends along less than an entire axial length of the respective first or second series of external splines.

17. The marine drive assembly of claim 11, wherein the nut is not removable from the at least one of the first and second propeller shafts without the respective one of the first and second driven gears being removed from the at least one of the first and second propeller shafts.

18. The marine drive assembly of claim 11, wherein both of the first and second propeller shafts comprise a series of threads formed in the respective first and second series of external splines.

19. The marine drive assembly of claim 11, wherein the marine drive assembly is configured to be held in a gear case of an outboard motor.

20. The marine drive assembly of claim 11, further comprising a washer surrounding the at least one of the first and second propeller shafts adjacent the nut.

* * * * *